United States Patent [19]

Chalabian

[11] 4,243,134

[45] Jan. 6, 1981

[54] COIN OPERATED VENDING APPARATUS WITH MULTIPLE COIN CHUTES

[75] Inventor: Jack S. Chalabian, Gardena, Calif.

[73] Assignee: K-Jack Engineering Company, Inc., Gardena, Calif.

[21] Appl. No.: 13,822

[22] Filed: Feb. 22, 1979

[51] Int. Cl.[3] ..... G07F 5/08

[52] U.S. Cl. ..... 194/59

[58] Field of Search ..... 194/102, 59, DIG. 15, 194/54, 68, 1 G

[56] References Cited

U.S. PATENT DOCUMENTS

| | | | |
|---|---|---|---|
| 3,760,923 | 9/1973 | Voegeli | 194/1 G |
| 3,884,330 | 5/1975 | Chalabian | 194/59 |

*Primary Examiner*—Stanley H. Tollberg

*Attorney, Agent, or Firm*—Smyth, Pavitt, Siegemund, Jones & Martella

[57] ABSTRACT

In the improved pawls of the present invention, the tip of the first finger is provided with an edge which is inclined upwardly toward the second finger. The coins in the first chute interact with this sloping edge as the door is drawn open, instead of with the side of the finger when the coins are inserted, to produce the slight pivotal movement of the pawl which positions the second finger in the second coin chute. The improved pawl requires both a first particular combination of coins in the first chute and a second particular combination of coins in the second chute to unlock the door.

13 Claims, 4 Drawing Figures

(FIG. 11 of 3,884,330)

COIN OPERATED VENDING APPARATUS WITH MULTIPLE COIN CHUTES

BACKGROUND OF THE INVENTION

1. Field of the Invention

The present invention relates to a coin operated vending machine which is mechanically actuated in accordance with the diameter of coins inserted thereinto. Such machines are often used for vending newspapers.

2. The Prior Art

The present invention includes improved pawls for use in a coin operated vending apparatus of the type disclosed in U.S. Pat. No. 3,884,330 issued May 20, 1975 to Chalabian, a copy of which will provide a better understanding of the background of the present invention. The disclosure of U.S. Pat. No. 3,884,330 is incorporated herein by reference.

In that patent, there is disclosed a coin operated vending machine in which the coin sorting mechanism comprises a pair of chutes for transferring coins from the slots into which they are inserted by the consumer to a position in which the coins are resting upon a locking bar which is pivotally mounted on the door of the machine. Selected pawls may be adjustably mounted relative to the chutes so as to extend into the chutes to cooperate with the upper edges of coins therein. A coin seat is formed on the locking bar and, as the consumer attempts to open the machine, the coin or coins become wedged between the pawl and the coin seat, biasing the locking bar away from a latching lever. If the proper coins are not inserted, the locking bar will not be actuated away from the latching lever, causing the lever to open the chutes throughout the entire length thereof, so that the coins and all other matter inserted into the slots would be rejected and returned to the consumer by deposit thereof in a coin return receptical. A wide variety of pawls were disclosed for use in the coin selection mechanism, depending upon the particular amount of money required to operate the machine.

Typically, the door of the vending machine can be opened by depositing any one of several combinations of coins, and a separate pawl is required for each possible combination. FIGS. 10–17 of U.S. Pat. No. 3,884,330 illustrate some of the possible pawls. These pawls may be grouped into two classes for purposes of description. In a first class are those pawls which interact only with the coins in one of the chutes (the pawls of FIGS. 13, 14 and 16). In a second class are those pawls which interact with coins in both chutes (the pawls of FIGS. 11, 12, 15 and 17).

In the pawls of the second class, coins inserted into a first chute act against the side of a first finger of the pawl causing the pawl to pivot slightly so that a second finger of the pawl is brought into a position within the second coin chute, the latching lever being actuated by the coins in the second chute. Through experience it has been found that objects other than coins can be inserted into the first chute to provide the desired pivoting action of the pawl, thereby defeating the mechanism. The improved pawls of the present invention have a shape which overcomes this problem.

A careful study of the pawls shown in FIGS. 11–17 of U.S. Pat. No. 3,884,330 reveals that the pawls of the first class (FIGS. 13, 14 and 16) require a particular combination of coins in one of the two chutes, while the pawls of the second class (FIGS. 11, 12, 15, and 17) require both a first combination of coins in the first chute and a second particular combination of coins in the second chute. However, none of the pawls is capable of operating on either a first particular combination of coins in the first chute or a second particular combination of coins in the second chute. As a result, in the either/or situation, it has in the past been necessary to use two separate pawls. This, in turn, makes the mechanism more complicated and results in the pawls being crowded together to a greater extent, necessitating the use of offsets in certain of the pawls. The present invention includes a pawl which can be operated in association with either a first combination of coins in a first chute or a second combination of coins in the second chute.

SUMMARY OF THE INVENTION

In accordance with the present invention there is provided a pawl of the type having two fingers to permit the vending machine to be unlocked when a particular first combination of coins has been inserted into a first coin chute and a second particular combination of coins has been inserted in a second chute, the pawl being improved by providing the tip of the first finger with an edge which is inclined upwardly and toward the second finger. The top edge of a coin is forced against the inclined tip of the first finger to cause an amount of pivotal motion of the pawl which is related to the diameter of the coin, and which would not be proper if some object of a different diameter were substituted for the coin. The amount of pivotal motion produced is sufficient to pivot the second finger into alignment with the second coin chute. The length of the second finger is such that when the second particular combination of coins is present in the second chute, the coins will be prevented by the tip of the second finger from being pushed up the coin chute. This forces the lowest edge of the lowest coin to bear against an actuator, driving the actuator to unlock the door. The purpose of the improved pawl of the present invention is to prevent the use of objects other than coins and slightly smaller than the designated coins to be used in the first chute to produce the desired small pivotal motion of the pawl.

In another aspect of the present invention, an improved pawl is provided with two coin abutment surfaces, one extending into each of the two coin chutes. In this manner, the sole pawl can interact with either the first particular combination of coins in the first chute or a second particular combination of coins in the second chute to drive the actuator to unlock the door. This arrangment of coin abutment surfaces permits a single pawl of the improved type to perform the function previously requiring the use of two separate pawls.

The novel features which are believed to be characteristic of the invention, both as to organization and method of operation, together with further objects and advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
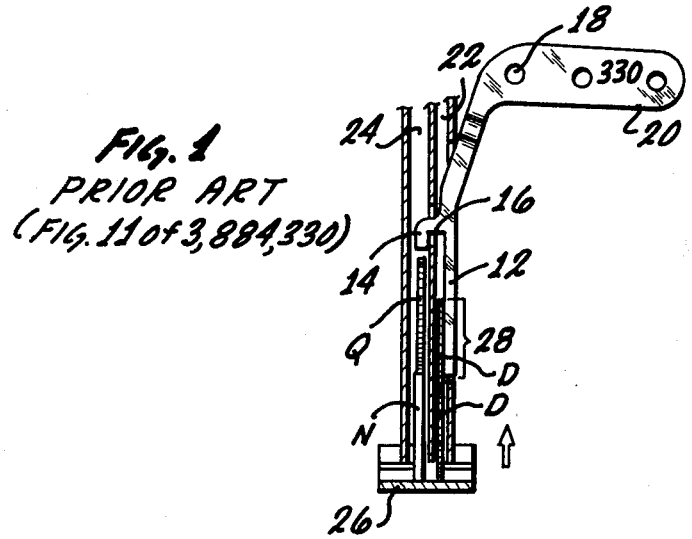
FIG. 1 PRIOR ART
FIG. 1 is an elevational view showing a pawl of the type used in the prior art.

Turning now to the drawings in which like parts are denoted by the same reference numeral, there is shown in FIG. 1 a pawl of the type disclosed in U.S. Pat. 3,884,330. The pawl includes a first finger 12 and a second finger 14 spaced from the first finger, but extending generally parallel to it so that a slot 16 is included between the fingers 12, 14. The pawl further includes a pivot 18 and a counterweight portion 20. The counterweight portion 29 biases the pawl to a pivotal position such that the slot 16 is aligned with the second chute 24.

When a particular coin or a particular combination of coins is inserted into the first chute 22, the coins fall to the bottom of the first chute, displacing the first finger 12 out of the first chute and thereby producing a small pivotal motion of the pawl in the direction indicated by the arrow to pivot the second finger 14 into alignment with the second chute 24. Thereafter, when a particular combination of coins has been inserted into the second chute 24, the second finger 14 prevents those coins from being pushed back up the second chute 24. Accordingly, when the actuator 26, which is mounted to the door, is pulled forward so that its upwardly curved portion contacts the portion of the coins extending below the bottom of the chutes, the coins react against the actuator 26 pushing downwardly thereby unlocking the door, as described in U.S. Pat. No. 3,884,330.

To accommodate some variation in the location of the actuator 26, some overlap 28 must be provided between the tip of the first finger 12 and the uppermost edge of the top coin in the first chute 22. Because of this overlap, an object slightly smaller than the coin could be used to produce rotation of the pawl.

In accordance with the improvement of the present invention, this problem is overcome by providing the tip of the first finger 12 with a cam 30 which is defined by the edge of the tip of the finger, which is inclined upwardly toward the second finger 14. This contrasts with the square tip of the first finger shown in FIG. 1. In the embodiments shown in FIGS. 2 and 3, the desired pivotal movement is produced as the coin or coins in the first chute 22 are forced upwardly against the cam 30 by the curved portion of the actuator 26 as the actuator is pulled forward. For this reason, the amount of pivotal movement produced is determined by the diameter of the coin or coins in the first chute, and if smaller objects are substituted for the proper coins, the amount of pivotal movement produced will not be adequate to bring the second finger 14 into alignment with the second chute 24. In that case, when the actuator 26 is drawn forward, the coins in the second chute will simply ride up into the slot 16 and will produce no appreciable reaction downward on the actuator 26, with the result that the door will not unlock.

Figure 2:
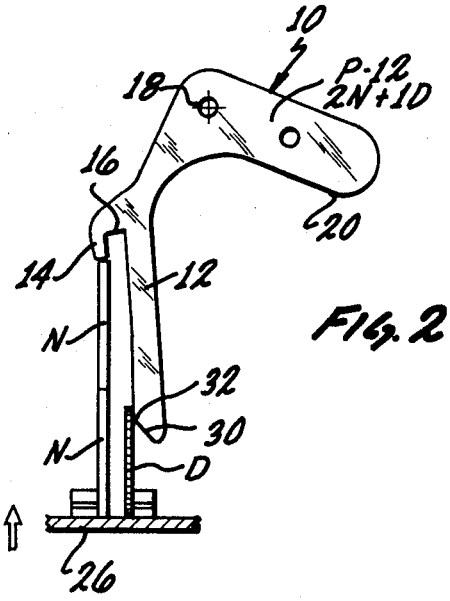
FIG. 2 is an elevational view of a preferred embodiment of the pawl of the present invention.
Figure 3:
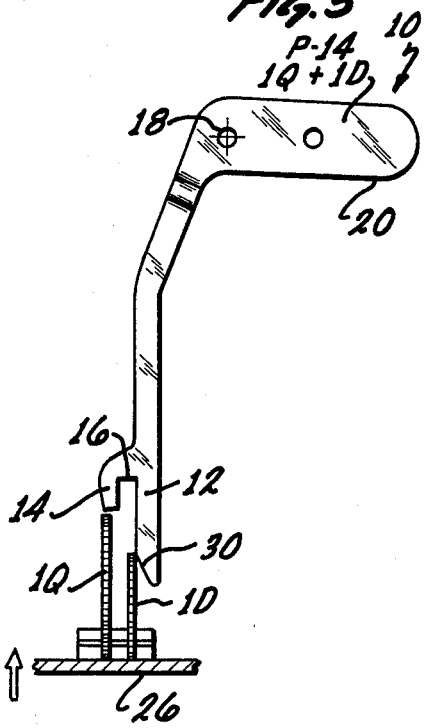
FIG. 3 is an elevational view of an alternative embodiment of the improved pawl of the present invention; and, FIG. 4 is an elevational view showing a pawl suitable for use with either a first particular combination of coins in a first chute or a second particular combination of coins in a second chute.

The pawl 10 shown in FIG. 3 operates in a manner similar to the pawl 10 shown in FIG. 2. The main difference being that in FIG. 3 the tips of the fingers are at approximately the same distance from the pivot 18, while in FIG. 2, the tip of the second finger 14 is substantially closer to the pivot 18 than the tip of the first finger 12. Accordingly, in FIG. 2 a larger amount of pivotal motion of the first finger is required to produce a given displacement of the second finger 14 than is the case in FIG. 3. For this reason, the pawl of FIG. 2 is provided with a bulge 32 on the side of the first finger that faces the second finger, to provide the necessarily longer cam 30.

The pawls of FIGS. 2 and 3 are adapted to unlock the door after a particular first combination of coins has been deposited in the first chute and a second particular combination of coins has been deposited in the second chute. Specifically, the pawl 10 of FIG. 2 unlocks the door after a dime has been deposited in the first chute and two nickels have been deposited in the second chute. The pawl of FIG. 3 is designed to unlock the door after a dime has been deposited in the first chute and a quarter has been deposited in the second chute.

Figure 4:
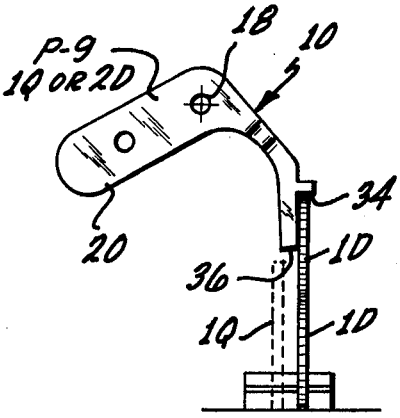

The pawl 10 of FIG. 4 has a structure which adapts it to unlock the door when either two dimes have been deposited in the first chute or after a quarter has been deposited in the second chute. This is accomplished by providing the pawl 10 of FIG. 4 with two separate coin abutment surfaces 34, 36. The first coin abutment surface 34 is positioned to lie in the first coin chute 22 and the second coin abutment surface 36 is positioned to lie within the second coin chute 24. This permits the door to be opened when two dimes are jammed between the first coin abutment surface 34 and the actuator 26 or when a quarter is jammed between the second coin abutment surface 36 and the actuator 26.

Thus, there have been described improved pawls for use in a coin actuated vending machine. In one embodiment, the improvement consists of providing the first finger with an upwardly-inclined tip to prevent objects other than coins from defeating the device. In another embodiment a single pawl is provided with two coin abutment surfaces so that the door can be unlocked by either of two possible combinations of coins.

The foregoing detailed description illustrates several embodiments of the invention, and it is to be understood that additional embodiments thereof will be obvious to those skilled in the art. The embodiments described herein together with those additional embodiments are considered to be within the scope of the invention.

What is claimed is:

1. In a coin-operated door lock of the type in which some movement of the door is possible while the door remains locked, having a curved actuator attached to the door for movement with it past the lower ends of juxtaposed first and second coin chutes and driven as the door is drawn in its direction of opening to unlock the door by contact with the edge of a coin extending beyond the lower end of the second coin chute, the coin being prevented from being pushed by the actuator back up into the chute by a pawl mounted adjacent the chute and having a coin-engaging finger extending into the chute, the pawl being mounted for pivotal motion with respect to the first and second coin chutes and being biased to a first pivotal position relative to the first and second coin chutes, the improvement comprising:

a pawl for enabling the door to be unlocked after a first particular combination of coins has been deposited in the first chute and a second particular combination of coins has been deposited in said second chute, said pawl having a unitary body of substantially uniform thickness and including:

a first finger extending into the first coin chute when said pawl is in the first pivotal position;

a second finger extending substantially parallel to said first finger but spaced from it so that a notch is defined between said first finger and said second finger, said notch being aligned with said second coin chute when said pawl is in the first pivotal position to permit a second particular combination of coins in the second chute to be pushed back up into the chute when said pawl is in the first pivotal position preventing the actuator from being driven to unlock the door;

the tip of said first finger having a shape defining a cam for rotating said pawl to a second pivotal position when the door is drawn in its direction of opening after a first particular combination of coins has been deposited in the first coin chute, the coins in the first chute being forced upwardly against the cam by movement of the curved actuator past the lower end of the first chute;

the rotation of said pawl from the first pivotal position to the second pivotal position causing said second finger to move into the second coin chute;

the tip of said second finger having a shape defining a coin abutment surface for preventing the second particular combination of coins from moving back up along the second chute when said pawl is in the second pivotal position, whereby the edge of a coin remains extended beyond the end of the second coin chute to drive the actuator as the door is drawn in its direction of opening, thereby unlocking the door after the first particular combination of coins has been deposited into the first chute and the second particular combination of coins has been deposited into the second chute.

2. The improvement of claim 1 wherein the edge of said first finger at the tip thereof is beveled upwardly toward said second finger to provide said cam.

3. The improvement of claim 1 wherein the width of said cam is sufficient to pivot the pawl to the second pivotal position at which said second finger extends into the second coin chute.

4. The improvement of claim 1 wherein the width of said first finger increases toward its tip.

5. The improvement of claim 1 wherein said second finger is shorter than said first finger.

6. The improvement of claim 1 wherein said pawl further comprises a counterweight portion for biasing it to the first pivotal position.

7. In a coin operated door lock of the type in which some movement of the door is possible while the door remains locked, having a curved actuator attached to the door for movement with it past the lower ends of juxtaposed first and second coin chutes and driven as the door is drawn in its direction of opening to unlock the door by contact with the edge of a coin extending beyond the lower end of the second coin chute, the coin being prevented from being pushed by the actuator back up into the chute by a pawl mounted adjacent the chute and having a coin engaging finger extending into the chute, the pawl being mounted for pivotal motion with respect to the first and second coin chutes and being biased to a first pivotal position relative to the first and second coin chutes, the improvement comprising:

a pawl for enabling the door to be unlocked after either a first particular combination of coins has been deposited in the first chute or a second particular combination of coins has been deposited in said second chute, said pawl having a unitary body of substantially uniform thickness and including:

a first finger extending into the first coin chute when said pawl is in the first pivotal position;

a second finger extending into the second coin chute when said pawl is in the first pivotal position;

the tip of said first finger having a first coin abutment surface for preventing a first particular combination of coins from moving back up the first coin chute when said pawl is in the first pivotal position;

the tip of said second finger having a second coin abutment surface for preventing a second particular combination of coins from moving back up the second coin chute when said pawl is in the first pivotal position;

whereby, when the first particular combination of coins has been deposited into the first coin chute, the edge of a coin remains extending beyond the end of the first coin chute to drive the actuator as the door is drawn in its direction of opening, thereby unlocking the door; and, whereby when the second particular combination of coins has been deposited into the second coin chute, the edge of a coin remains extending beyond the end of the second coin chute to drive the actuator as the door is drawn in its direction of opening, thereby unlocking the door.

8. The improvement of claim 7 wherein said pawl further comprises a counterweight portion for biasing it to the first pivotal position.

9. In a coin-operated door lock having a first coin chute and a second coin chute in which a coin or coins of preselected denomination within the second chute act as a column in transmitting an unlocking force from a coin abutment surface of a locking pawl in its active position to a door-opening actuator as the actuator is moved relative to the first and second coin chutes, the improvement comprising:

a cam surface on said pawl which extends into the first coin chute when the pawl is in an inactive position in which the coin abutment surface of the pawl is not positioned within the second chute;

said cam surface being shaped and positioned for contact by a coin of a preselected size within the first coin chute on movement of the coin within the first chute through contact with the actuator as it moves relative to the first coin chute, and the contact of the coin with the cam surface within the first chute providing movement of the pawl from its inactive position to its active position to permit transmission of an unlocking force from the coin abutment surface to the door-opening actuator, whereby the insertion of a coin within the first coin chute of a size smaller than said preselected size does not provide contact with the cam surface that is required to move the locking pawl from its inactive position to its active position.

10. The coin-operated door lock of claim 9 wherein said cam surface is inclined in the direction of said coin abutment surface.

11. A coin-operated door lock comprising:

a first coin chute and a second coin chute;

a door-opening actuator movable with respect to the first and second coin chutes;

a locking pawl having a first coin abutment surface and a second coin abutment surface;

said pawl having an active position in which the first coin abutment surface is positioned within the first coin chute and the second coin abutment surface is positioned within the second coin chute;

the position of the first coin abutment surface within the first chute permitting a coin or coins of preselected denomination within the first chute to act as a column in transmitting an unlocking force from the first coin abutment surface to the door-opening actuator on movement of the actuator with respect to the first chute;

the position of the second coin abutment surface within the second chute permitting a coin or coins of preselected denomination within the second chute to act as a column in transmitting an unlocking force from the second coin abutment surface to the door-opening actuator on movement of the actuator with respect to the second chute, and means to bias said pawl to its active position, whereby an unlocking force may be transmitted to the door-opening actuator by the presence of either a coin or coins of preselected denomination within the first chute or a coin or coins of preselected denomination within the second chute.

12. The coin-operated door lock of claim 11 wherein said pawl includes a first finger with the first coin abutment surface being formed on said first finger and a second finger with the second coin abutment surface being formed on said finger, and said first finger and said second finger being joined together to form a generally L-shaped configuration.

13. The coin-operated door lock of claim 12 wherein the generally L-shaped configuration of the joined first and second fingers provides a longer leg formed by one of the fingers and a shorter leg formed by the other of the fingers, and one of said coin abutment surfaces being formed by an end surface of the finger forming the longer leg and the other of the coin abutment surfaces being formed by a side surface of the finger forming the shorter leg.

* * * * *